US011654475B2

(12) United States Patent
Killen

(10) Patent No.: US 11,654,475 B2
(45) Date of Patent: May 23, 2023

(54) RIVET SETTING TOOL

(71) Applicant: MILWAUKEE ELECTRIC TOOL CORPORATION, Brookfield, WI (US)

(72) Inventor: Bradley S. Killen, Elkhorn, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/338,297

(22) Filed: Jun. 3, 2021

(65) Prior Publication Data

US 2021/0379646 A1 Dec. 9, 2021

Related U.S. Application Data

(60) Provisional application No. 63/033,900, filed on Jun. 3, 2020.

(51) Int. Cl.
*B21J 15/10* (2006.01)
*B21J 15/26* (2006.01)
(Continued)

(52) U.S. Cl.
CPC ..... *B21J 15/105* (2013.01); *B21J 15/043* (2013.01); *B21J 15/26* (2013.01); *B21J 15/285* (2013.01)

(58) Field of Classification Search
CPC B21J 15/043–045; B21J 15/105; B21J 15/16; B21J 15/26; B21J 15/28–285; B25B 21/001; B25B 27/0014
See application file for complete search history.

(56) References Cited

U.S. PATENT DOCUMENTS 5,323,946 A 6/1994 O'Connor et al.
5,473,805 A 12/1995 Wille
(Continued)

FOREIGN PATENT DOCUMENTS

CN 100393447 C 6/2008
CN 102000760 A 4/2011
(Continued)

OTHER PUBLICATIONS

International Search Report and Written Opinion for Application No. PCT/US2021/035720 dated Sep. 23, 2021 (11 pages).
(Continued)

*Primary Examiner* — Matthew P Travers
(74) *Attorney, Agent, or Firm* — Michael Best & Friedrich LLP

(57) ABSTRACT

A rivet tool for setting a rivet, the rivet tool including a motor and a pulling mechanism. The pulling mechanism is configured to receive torque from the motor and includes a moveable member moveable between first and second positions. A plurality of jaws are configured to Clamp onto a mandrel of the rivet and pull the mandrel in response to the moveable member moving from the first position to the second position. A magnet is coupled for movement with the moveable member and includes a north pole face, an adjacent south pole face, and a pole junction therebetween. The north and south pole faces face away from the moveable member. A first sensor is configured to detect the pole junction when the moveable member is in the first position. A second sensor is configured to detect the pole junction when the moveable member is in the second position.

26 Claims, 5 Drawing Sheets

(51) Int. Cl.
*B21J 15/04* (2006.01)
*B21J 15/28* (2006.01)

(56) References Cited

U.S. PATENT DOCUMENTS

| | | | | |
|---|---|---|---|---|
| 5,605,070 | A | 2/1997 | Wille | |
| 5,960,667 | A | 10/1999 | Hylwa et al. | |
| 6,018,978 | A | 2/2000 | Aniento | |
| 6,026,551 | A | 2/2000 | Honsel et al. | |
| 6,141,849 | A | 11/2000 | Honsel et al. | |
| 6,145,360 | A | 11/2000 | Honsel et al. | |
| 6,163,945 | A | 12/2000 | Amano et al. | |
| 6,182,345 | B1 | 2/2001 | Travis | |
| 6,212,931 | B1 | 4/2001 | Solfronk | |
| 6,272,899 | B1 | 8/2001 | Bentivogli | |
| 6,276,037 | B1 | 8/2001 | Solfronk | |
| 6,301,948 | B1 | 10/2001 | Weiland | |
| 6,367,139 | B2 | 4/2002 | Wille | |
| 6,425,170 | B1 | 7/2002 | Zirps et al. | |
| 6,622,363 | B2 | 9/2003 | Komsta | |
| 6,629,360 | B2 | 10/2003 | Ohuchi | |
| 6,637,099 | B1 | 10/2003 | Seewraj | |
| 6,684,470 | B1 | 2/2004 | Joux | |
| 6,883,216 | B2 | 4/2005 | Gilbert et al. | |
| 6,886,226 | B1 | 5/2005 | Dear et al. | |
| 6,904,831 | B2 | 6/2005 | Aasgaard | |
| 6,907,648 | B2 | 6/2005 | Eldessouky | |
| 6,907,649 | B2 | 6/2005 | Yamada | |
| 6,918,279 | B2 | 7/2005 | Wille | |
| 6,925,695 | B2 | 8/2005 | Woyciesjes et al. | |
| 7,040,010 | B2 | 5/2006 | Bouman | |
| 7,043,807 | B2 | 5/2006 | Woyciesjes et al. | |
| 7,082,657 | B1 | 8/2006 | Lin | |
| 7,140,227 | B2 | 11/2006 | Bouman et al. | |
| 7,159,291 | B2 | 1/2007 | Ohuchi | |
| 7,322,783 | B2 | 1/2008 | Pearce et al. | |
| 7,331,205 | B2 | 2/2008 | Chitty et al. | |
| 7,346,971 | B2 | 3/2008 | Chitty | |
| 7,347,078 | B1 | 3/2008 | Hopkins et al. | |
| 7,464,454 | B2 | 12/2008 | Aasgaard | |
| 7,503,133 | B2 | 3/2009 | Muraoka | |
| 7,503,196 | B2 | 3/2009 | Chitty et al. | |
| 7,559,133 | B2 | 7/2009 | Chitty et al. | |
| 7,698,794 | B2 | 4/2010 | Cobzaru | |
| 7,712,209 | B2 | 5/2010 | Bouman et al. | |
| 7,818,859 | B2 | 10/2010 | Pearce et al. | |
| 8,015,699 | B2 | 9/2011 | Fulbright | |
| 8,091,195 | B2 | 1/2012 | Lin | |
| 8,099,846 | B2 | 1/2012 | King et al. | |
| 8,109,123 | B2 | 2/2012 | Chen | |
| 8,151,423 | B2 | 4/2012 | Dear et al. | |
| 8,161,622 | B2 | 4/2012 | King et al. | |
| 8,256,104 | B2 | 9/2012 | Fulbright | |
| 8,365,375 | B2 | 2/2013 | Lin | |
| 8,443,512 | B2 | 5/2013 | Masugata | |
| 8,474,119 | B2 | 7/2013 | Lv et al. | |
| 8,615,860 | B2 | 12/2013 | Cobzaru et al. | |
| 8,677,587 | B2 | 3/2014 | Liu | |
| 8,677,588 | B2 | 3/2014 | Soller | |
| 8,689,419 | B2 | 4/2014 | Lin | |
| 8,707,530 | B2 | 4/2014 | Lin | |
| 8,904,612 | B1 | 12/2014 | Lin | |
| 8,935,948 | B1 | 1/2015 | Gregory | |
| 9,079,240 | B2 | 7/2015 | Schiffler et al. | |
| 9,180,510 | B2 | 11/2015 | Sugata et al. | |
| 9,289,818 | B2 | 3/2016 | Skolaude | |
| 9,440,340 | B2 | 9/2016 | Hsu et al. | |
| 9,849,502 | B2 | 12/2017 | Gaertner et al. | |
| 10,232,429 | B1 * | 3/2019 | Lin | G01R 33/072 |
| 2006/0150402 | A1 | 7/2006 | Lin | |
| 2006/0179631 | A1 | 8/2006 | Lin | |
| 2006/0180629 | A1 | 8/2006 | Lin | |
| 2007/0295779 | A1 | 12/2007 | Fulbright | |
| 2008/0012453 | A1 | 1/2008 | Aasgaard | |
| 2008/0210060 | A1 | 9/2008 | Aasgaard | |
| 2009/0031545 | A1 | 2/2009 | Keppel | |
| 2009/0205184 | A1 | 8/2009 | Seewraj et al. | |
| 2010/0071182 | A1 | 3/2010 | Ho et al. | |
| 2010/0139066 | A1 | 6/2010 | Chen | |
| 2010/0275424 | A1 | 11/2010 | Masugata | |
| 2010/0295696 | A1 | 11/2010 | Chu | |
| 2011/0271504 | A1 | 11/2011 | Preti | |
| 2011/0289745 | A1 | 12/2011 | Ho | |
| 2012/0104304 | A1 | 5/2012 | Lin | |
| 2012/0240371 | A1 | 9/2012 | Mori | |
| 2013/0117981 | A1 | 5/2013 | Seewraj et al. | |
| 2013/0205577 | A1 | 8/2013 | Soller | |
| 2013/0312245 | A1 | 11/2013 | Skolaude et al. | |
| 2014/0100687 | A1 | 4/2014 | Ekstrom et al. | |
| 2014/0101908 | A1 | 4/2014 | Cobzaru et al. | |
| 2014/0224831 | A1 * | 8/2014 | Naughton | G01F 11/029 222/326 |
| 2014/0250649 | A1 | 9/2014 | Masugata | |
| 2015/0040373 | A1 | 2/2015 | Chen | |
| 2015/0044964 | A1 | 2/2015 | Khan et al. | |
| 2015/0074964 | A1 | 3/2015 | Masugata | |
| 2015/0336159 | A1 | 11/2015 | Gaertner et al. | |
| 2015/0360355 | A1 | 12/2015 | Hsu et al. | |
| 2016/0045950 | A1 | 2/2016 | Gaertner et al. | |
| 2016/0107224 | A1 | 4/2016 | King | |
| 2016/0114383 | A1 * | 4/2016 | Honsel | B21J 15/02 29/525.07 |
| 2019/0351477 | A1 * | 11/2019 | Yabuguchi | B21J 15/045 |
| 2020/0130047 | A1 | 4/2020 | Yabunaka et al. | |
| 2020/0142010 | A1 * | 5/2020 | Chowdhury | G01R 33/091 |
| 2022/0105616 | A1 * | 4/2022 | Wirnitzer | B25D 11/005 |

FOREIGN PATENT DOCUMENTS

| | | | |
|---|---|---|---|
| CN | 101579717 | B | 5/2011 |
| CN | 202087763 | U | 12/2011 |
| CN | 102225453 | B | 1/2013 |
| CN | 203091652 | U | 7/2013 |
| CN | 204247901 | U | 4/2015 |
| CN | 105414439 | A | 3/2016 |
| DE | 29914202 | U1 | 12/2000 |
| DE | 20104373 | U1 | 6/2001 |
| DE | 10115728 | A1 | 10/2001 |
| DE | 202004004148 | U1 | 7/2004 |
| DE | 202004012268 | U1 | 12/2005 |
| DE | 202004012269 | U1 | 12/2005 |
| DE | 202006014607 | U1 | 11/2006 |
| DE | 202009001230 | U1 | 4/2009 |
| DE | 102008013044 | B3 | 7/2009 |
| DE | 202010007250 | U1 | 10/2010 |
| DE | 202012101490 | U1 | 5/2012 |
| DE | 10316578 | B4 | 6/2012 |
| DE | 202012101492 | U1 | 8/2012 |
| DE | 102011001198 | B4 | 11/2012 |
| DE | 102013219217 | A1 | 3/2015 |
| DE | 102013221789 | A1 | 4/2015 |
| DE | 102013221790 | A1 | 5/2015 |
| DE | 102013221792 | A1 | 5/2015 |
| DE | 102014223303 | A1 | 5/2016 |
| EP | 0927586 | A2 | 7/1999 |
| EP | 0787563 | B1 | 4/2002 |
| EP | 1297916 | A2 | 4/2003 |
| EP | 0928649 | B1 | 6/2003 |
| EP | 1300205 | B1 | 4/2005 |
| EP | 0927585 | B1 | 4/2006 |
| EP | 1232812 | B1 | 1/2007 |
| EP | 2113317 | A1 | 11/2009 |
| EP | 1738845 | B1 | 1/2013 |
| EP | 2823911 | A2 | 1/2015 |
| EP | 2626154 | B1 | 12/2015 |
| EP | 2565469 | B1 | 3/2016 |
| FR | 2990634 | B1 | 2/2015 |
| FR | 3013999 | A1 | 6/2015 |
| WO | WO0196045 | A1 | 12/2001 |
| WO | WO03078090 | A1 | 9/2003 |
| WO | WO2005025772 | A1 | 3/2005 |
| WO | WO2008099132 | A1 | 8/2008 |
| WO | WO2008119849 | A1 | 10/2008 |
| WO | WO2009007825 | A2 | 1/2009 |

(56) References Cited

FOREIGN PATENT DOCUMENTS

| | | | |
|---|---|---|---|
| WO | WO2009072836 | A2 | 6/2009 |
| WO | WO2011060499 | A1 | 5/2011 |
| WO | WO2012120132 | A1 | 9/2012 |
| WO | WO2015049738 | A1 | 4/2015 |

OTHER PUBLICATIONS

Gesipa, "Blind Riveting Tools," Spare Parts Programme, Apr. 1, 2008 (4 pages).

Gesipa, "Blind Rivet Tools: Portable Electric Installation Tools," <https://web.archive.org/web/20060904084600/http://www.gesipausa.com/portable_installation_tools.htm> web page publicly available at least as early as Sep. 4, 2006.

* cited by examiner

RIVET SETTING TOOL

CROSS-REFERENCE TO RELATED APPLICATIONS

This application claims priority to U.S. Provisional Patent Application No. 63/033,900, filed on Jun. 3, 2020, the entire content of which is incorporated herein by reference.

FIELD

The present disclosure relates to rivet setting tools, and more particularly to pulling mechanisms for rivet setting tools.

BACKGROUND

Rivet setting tools use pulling mechanisms to pull a mandrel of a rivet to set a rivet. Pulling mechanisms sometimes have pulling members that move between a first position, in which the mandrel is ready to be received in the pulling mechanism, and a second position, in which the mandrel has been separated from the rivet, such that the pulling member can return to the first position.

SUMMARY

The present disclosure provides, in one aspect, a rivet tool for setting a rivet. The rivet tool includes a motor and a pulling mechanism configured to receive torque from the motor. The pulling mechanism includes a moveable member that is moveable between a first position and a second position in response to the pulling mechanism receiving torque from the motor, a plurality of jaws configured to clamp onto a mandrel of the rivet and pull the mandrel in response to the moveable member moving from the first position to the second position, and a magnet coupled for movement with the moveable member. The magnet includes a north pole face, an adjacent south pole face, and a pole junction therebetween. The north and south pole faces face away from the moveable member. The rivet tool further comprises a first sensor configured to detect the pole junction when the moveable member is in the first position and a second sensor configured to detect the pole junction when the moveable member is in the second position.

In some implementations, the north pole face and the south pole face are coplanar.

In some implementations, the magnet is moveable along a face plane defined by the north pole face and the south pole face.

In some implementations, the face plane is parallel to a pulling axis along which the moveable member moves between the first and second positions.

In some implementations, the second sensor is a north pole-detecting Hall-effect sensor. When the moveable member moves to the second position, the second sensor is configured to output a signal to a controller indicating that a north pole flux detected by the second sensor is zero.

In some implementations, in response to the controller receiving the signal from the second sensor indicating that north pole flux detected by the second sensor is zero, the controller is configured to deactivate the motor.

In some implementations, the first sensor is a south pole-detecting Hall-effect sensor. When the moveable member moves to the first position, the first sensor is configured to output a signal to the controller indicating that a south pole flux detected by the first sensor is zero.

In some implementations, in response to the controller receiving the signal from the first sensor indicating that south pole flux detected by the first sensor is zero, the controller is configured to deactivate the motor.

In another aspect, the disclosure provides a rivet tool for setting a rivet. The rivet tool includes a motor, and a pulling mechanism configured to receive torque from the motor and pull the rivet. The pulling mechanism includes a moveable member that is moveable between a first position and a second position in response to the pulling mechanism receiving torque from the motor. The pulling mechanism also includes a magnet coupled for movement with the moveable member, the magnet including a north pole face, an adjacent south pole face, and a pole junction therebetween. The rivet tool also includes a sensor configured to detect the pole junction when the moveable member is in the first position.

In yet another aspect, the disclosure provides a power tool including a motor, a moveable member that is moveable between a first position and a second position in response to receiving torque from the motor, and a magnet coupled for movement with the moveable member. The magnet includes a north pole face, an adjacent south pole face, and a pole junction therebetween. The power tool also includes a sensor configured to detect the pole junction when the moveable member is in the first position, and a controller configured to deactivate the motor based on a position of the pole junction detected by the sensor.

Other features and aspects of the disclosure will become apparent by consideration of the following detailed description and accompanying drawings.

Before any implementations of the disclosure are explained in detail, it is to be understood that the disclosure is not limited in its application to the details of construction and the arrangement of components set forth in the following description or illustrated in the following drawings. The disclosure is capable of other implementations and of being practiced or of being carried out in various ways. Also, it is to be understood that the phraseology and terminology used herein is for the purpose of description and should not be regarded as limiting.

DETAILED DESCRIPTION

Figure 1:
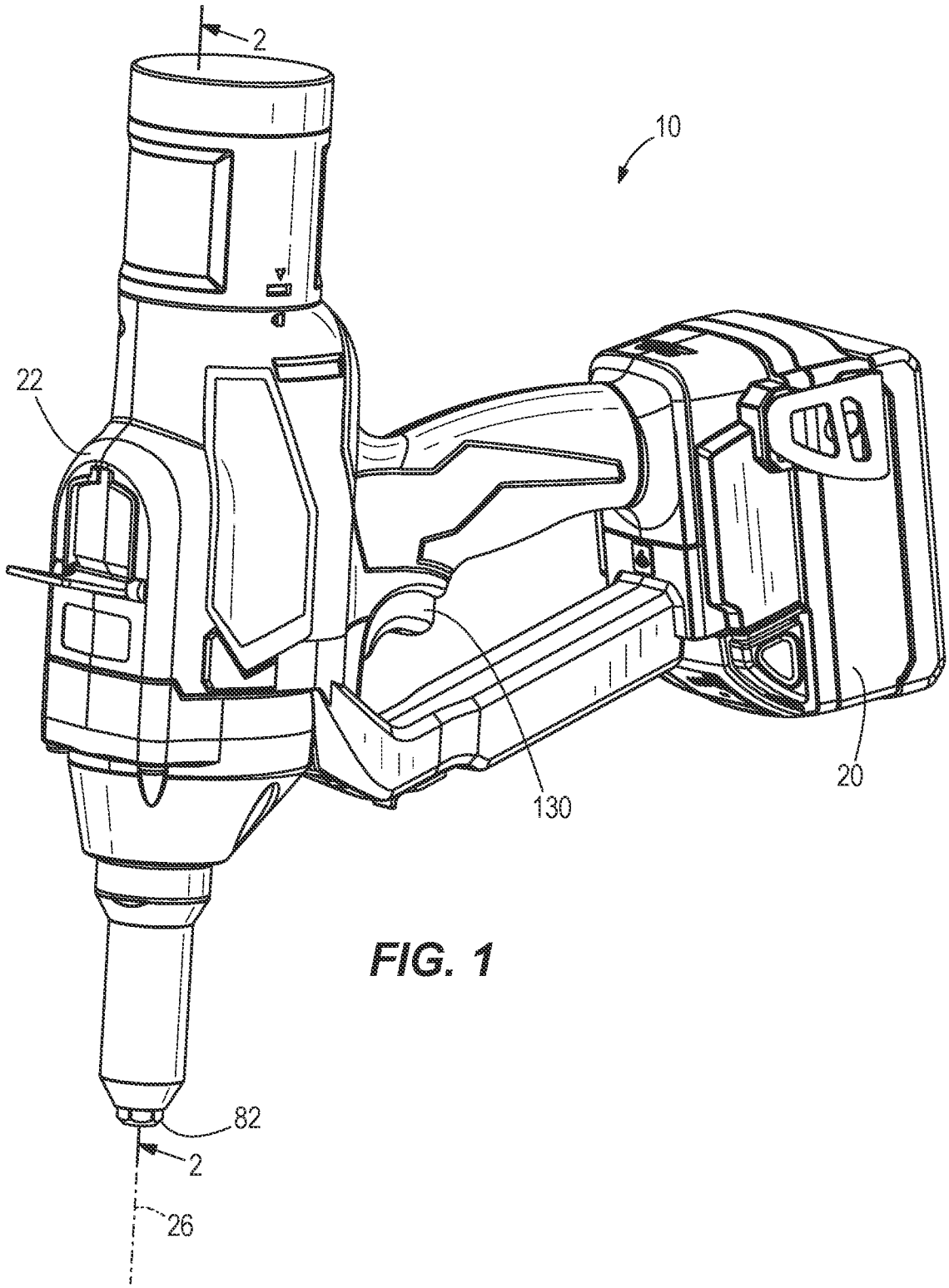
FIG. 1 is a perspective view of a rivet setting tool.
Figure 2:
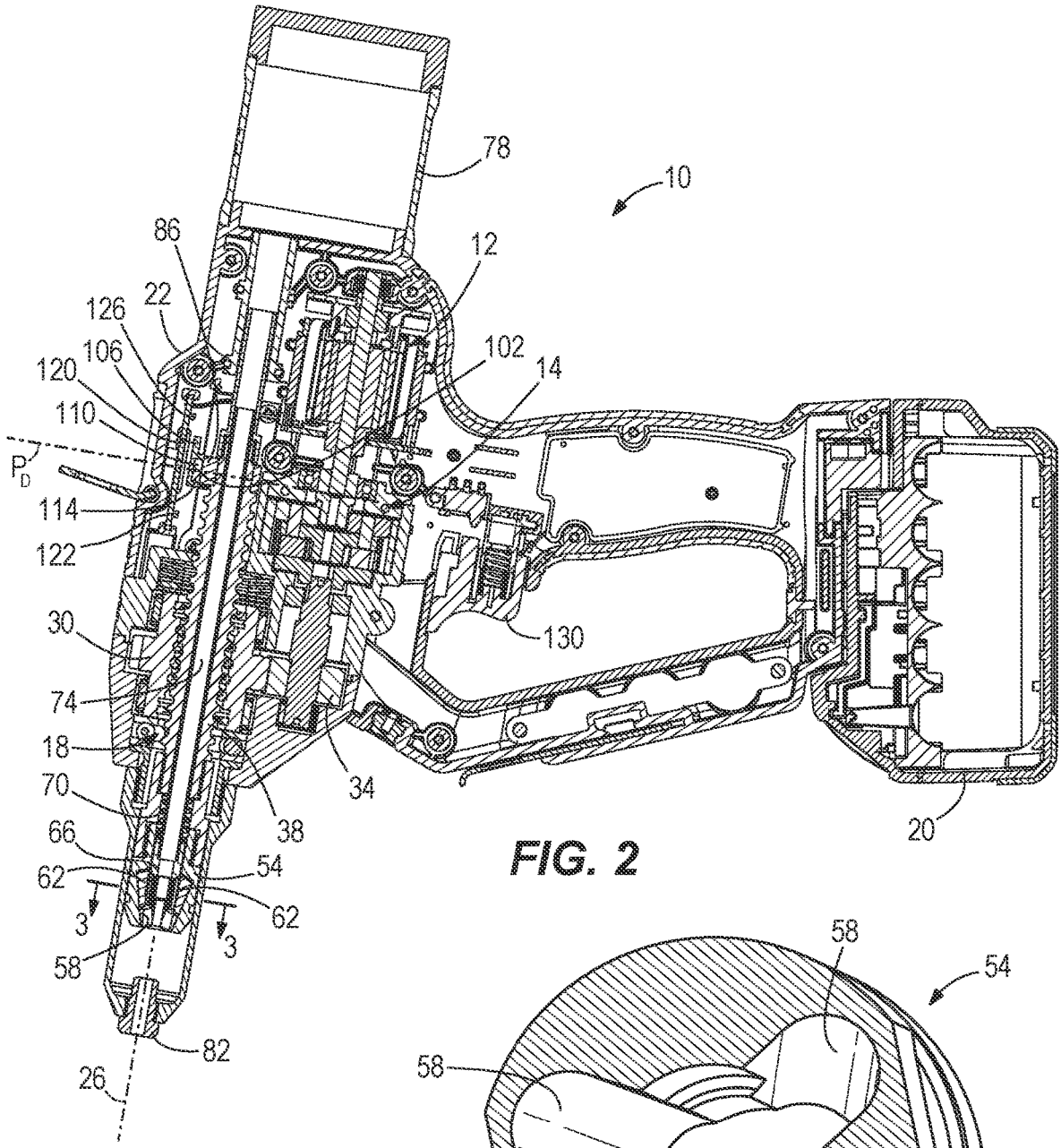
FIG. 2 is a cross-sectional view of the rivet setting tool of FIG. 1.

With reference to FIGS. 1 and 2, a rivet setting tool 10, such as a blind rivet setting tool, a rivet nut setting tool, or other deformable fastener setting tools, includes an electric motor 12 and a transmission 14 (e.g., a multi-stage planetary transmission) that receives torque from the motor 12. The tool 10 also includes a pulling mechanism 18 that is actuated in response to activation of the motor 12 to initiate a rivet setting process. In the illustrated implementation, the rivet setting tool 10 includes a battery pack 20 for providing power to the motor 12. In other implementations, the rivet setting tool 10 may include an electrical cord for connection to a remote power source (e.g., an alternating current source).

With reference to FIG. 2, the tool 10 includes a housing 22 in which the pulling mechanism 18 is positioned and arranged along a pulling axis 26 along which a rivet is pulled. For example, the rivet may include a mandrel that is pulled, or may include a rivet nut or other deformable fastener in other implementations. The pulling mechanism 18 includes a ball nut 30 that receives torque from a gear 34 of the transmission 14, and a pulling member, such as a ball screw 38, arranged within the pulling head 30. A plurality of rollers 42 (FIG. 5) are arranged between threads 46 of the ball nut 30 and threads 50 of the ball screw 38 such that in response to rotation of the ball nut 30 about the pulling axis 26, the rollers 42 facilitate smooth axial movement of the ball screw 38 between a first position and a second position, as explained in further detail below.

Figure 3:
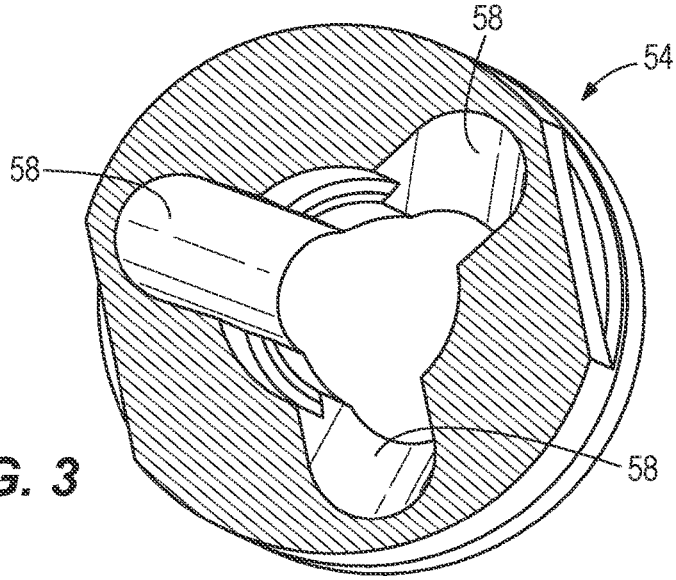
FIG. 3 is a partial cross-sectional view of a jaw sleeve of the rivet setting tool of FIG. 1.

With reference to FIG. 2, the pulling mechanism 18 also includes a jaw sleeve 54 that is coupled to the ball screw 38 for movement therewith. With reference to FIG. 3, the jaw sleeve 54 includes a plurality of interior recesses 58 that are obliquely oriented with respect to the pulling axis 26, converging in a direction away from the ball screw 38. The pulling mechanism 18 also includes a plurality of jaws 62 (FIG. 2), with each jaw 62 respectively arranged within each of the recesses 58. The jaws 62 are biased away from the ball screw 38 by a jaw pusher 66, which is in turn biased away from the ball screw 38 by a compression spring 70 that is arranged within the jaw sleeve 54 and seated against the ball screw 38. A spent-mandrel tube 74 extends along the pulling axis 26 through the jaw pusher 66, the compression spring 70, and the ball screw 38, terminating in a mandrel container 78 to collect severed mandrels after a rivet-setting operation has been completed. A nosepiece 82 is coupled to the housing 22 at an end opposite the mandrel container 78.

Figure 4:
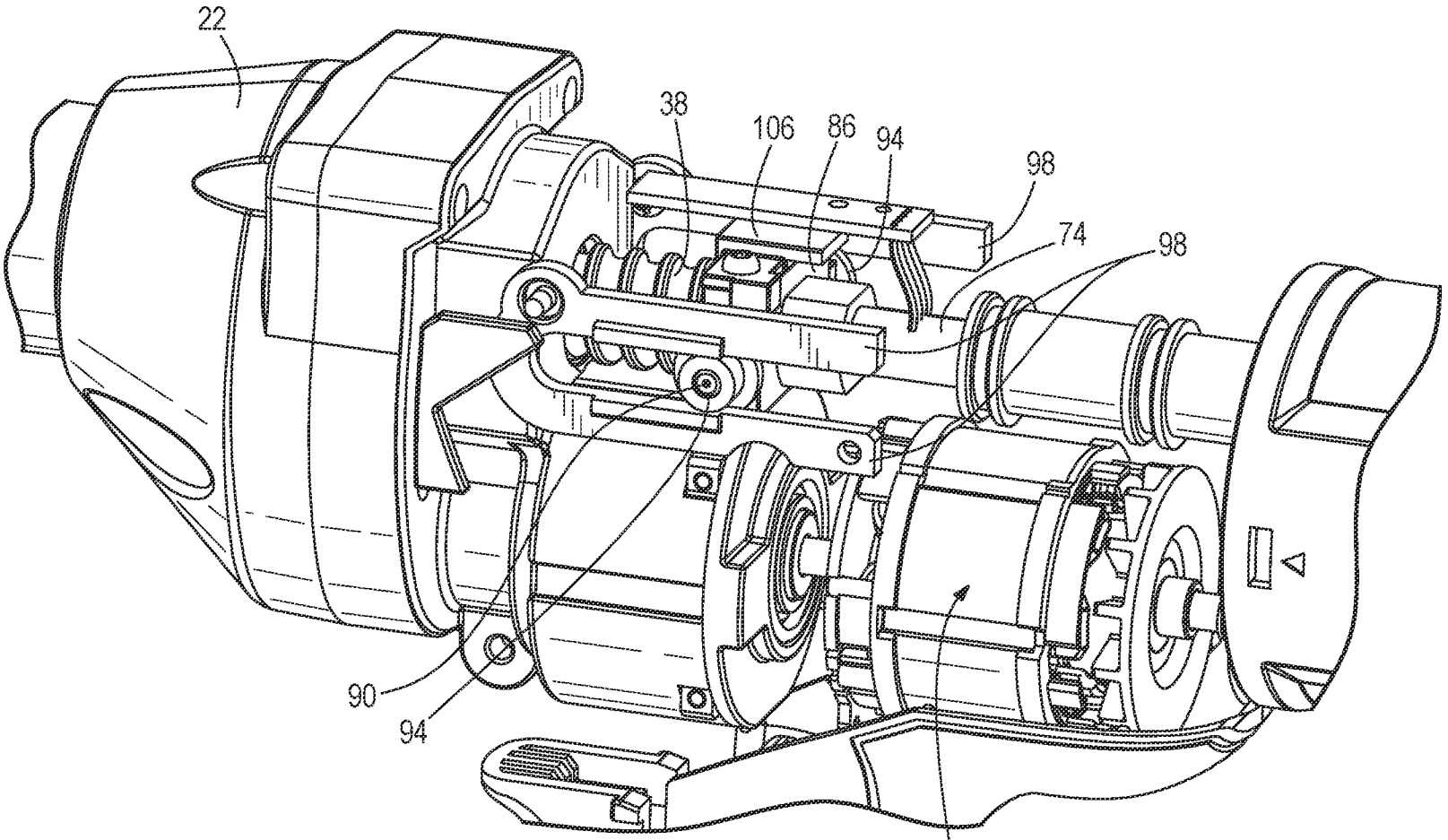
FIG. 4 is a perspective view of the rivet setting tool of FIG. 1, with portions removed.
Figure 5:
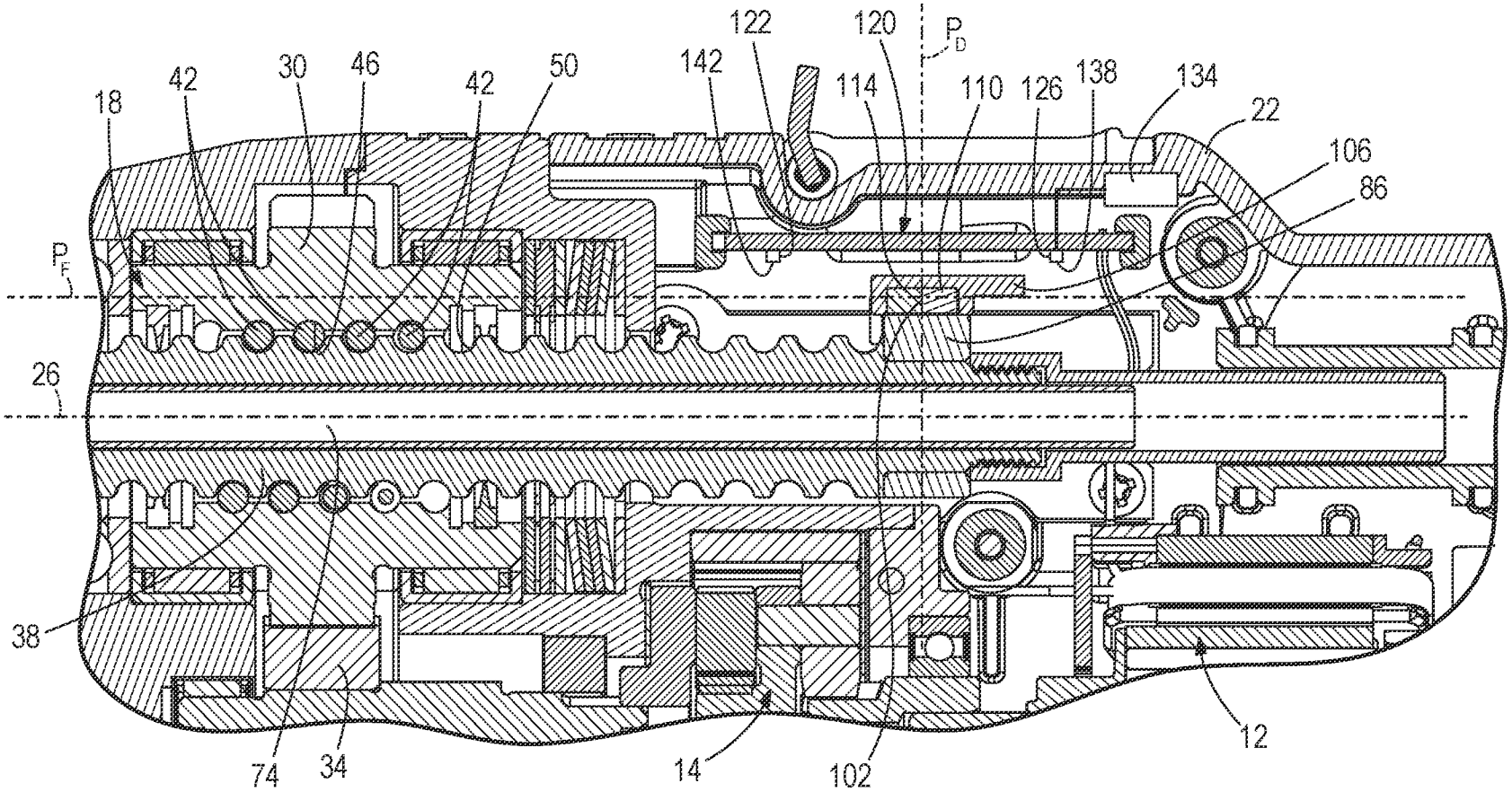
FIG. 5 is an enlarged cross-sectional view of the rivet setting tool of FIG. 1.

With reference to FIGS. 2, 4, and 5, a carrier 86 is coupled to the ball screw 38 and includes a pair of oppositely extending posts 90 on which a pair of rollers 94 are respectively arranged (FIG. 4). Each roller 94 is respectively arranged and configured to roll between a pair of rails 98. The carrier 86 is rotationally affixed to the ball screw 38 and prevents the ball screw 38 from rotating about the pulling axis 26 in response to rotation of the ball nut 30. Specifically, because the rollers 94 supported by the carrier 86 are confined between the rails 98, in response to rotation of the ball nut 30, the ball screw 38 is inhibited from rotating, and is instead limited to a single degree of freedom (i.e., translation along the pulling axis 26) between a first, home position, in which a mandrel of the rivet may be set in the jaws 62, and a second, complete position, in which the mandrel has been severed from the rivet and the setting operation is complete.

Figure 6:
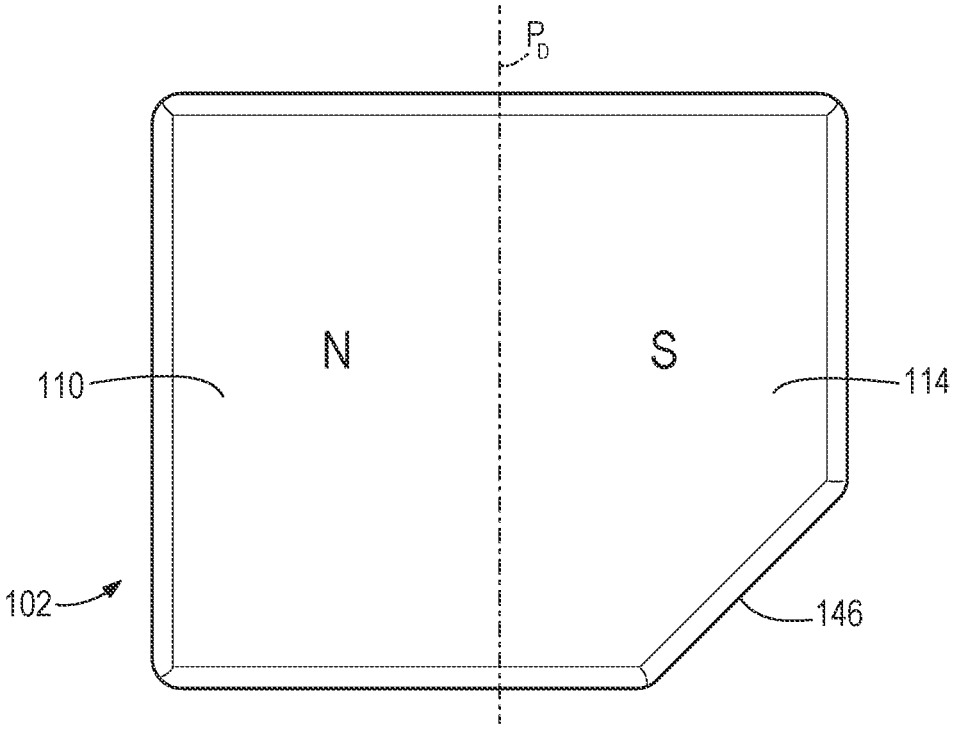
FIG. 6 is a plan view of a magnet of the rivet setting tool of FIG. 1.
Figure 7:
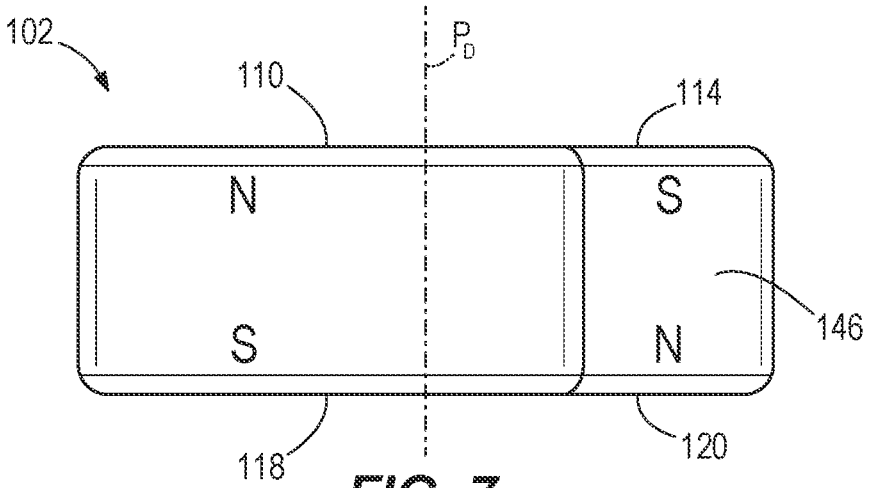
FIG. 7 is an elevation view of a magnet of the rivet setting tool of FIG. 1.

With continued reference to FIGS. 2, 4, and 5, a magnet 102 is supported upon the carrier 86 and is covered by a magnet cover 106. With reference to FIG. 6, the magnet 102 includes a North pole face 110 and an adjacent South pole face 114. The North pole face 110 is separated from the South pole face 114 by a pole junction (indicated by plane $P_D$) that is perpendicular to the pulling axis 26. As shown in FIG. 5, in the illustrated implementation, the north and South pole faces 110, 114 are coplanar, with the north and South pole faces 110, 114 collectively defining a face plane $P_F$ (FIG. 5) that is parallel to the pulling axis 26. As also shown in FIG. 5, both of the north and South pole faces 110, 114 face away from the ball screw 38 and both of the north and South pole faces 110, 114 are in facing relationship with a printed circuit board (PCB) 120 that is parallel to the pulling axis 26. As shown in FIG. 7, the magnet 102 includes a second South pole face 118 on a side of the magnet 102 opposite the North pole face 110 and a second North pole face 120 on the side of the magnet 102 opposite the South pole face 114.

When the ball screw 38 is in the first position, the magnet 102 is proximate a first sensor 122 on the PCB 120. As described in further detail below, the first sensor 122 is configured to detect presence of the magnet 102 when the ball screw 38 is in the first position. When the ball screw 38 is in the second position, the magnet 102 is proximate a second sensor 126 on the PCB 120. As described in further detail below, the second sensor 126 is configured to detect presence of the magnet 102 when the ball screw 38 is in the second position. In the illustrated implementation, the first and second sensors 122, 126 are Hall-effect sensors.

In operation, an operator inserts a mandrel of a rivet through the nosepiece 82. The mandrel initially pushes the jaws 62 away from the nosepiece 82, along their respective recesses 68, until the jaws 62 move far enough away from the pulling axis 26 that the mandrel moves between the jaws 62. The jaws 62, biased by the jaw pusher 66 toward the nosepiece 82, thereafter exert a radial clamping force on the mandrel. The operator then pulls a trigger 130 on the tool 10 to rotate the motor 12 in a first rotational direction, which causes the transmission 14 to rotate the gear 34, thus causing the ball nut 30 to rotate. Rotation of the ball nut 30 causes the ball screw 38 to translate from the first position toward the second position (toward the right in the frame of reference of FIG. 5). As the ball screw 38 translates from the first position toward the second position, the jaw sleeve 54 is also drawn away from the nosepiece 82 in unison with the ball screw 38, causing the mandrel to be drawn, via the clamped jaws 54, away from the nosepiece 82. As the ball screw 38 continues to move toward the second position, the rivet is eventually set on the workpiece and the mandrel is severed prior to or upon the ball screw 38 reaching the second position. As noted above, when the ball screw 38 reaches the second position, the second sensor 126 detects that the magnet 102 is proximate the second sensor 126.

The second sensor 126 detects when the ball screw 38 has reached the second position because the magnet 102 includes adjacent North pole and South pole faces 110, 114. Specifically, in the illustrated implementation, the second sensor 126 is a North pole-detecting Hall-effect sensor and is configured to output a signal indicative of detected North pole magnetic flux to a controller 134 (shown schematically in FIG. 5). As the magnet 102 translates with the ball screw 38 toward the second sensor 126, the second sensor 126 first detects the North pole magnetic flux from the North pole face 110, prior to the ball screw 38 reaching the second position.

When the ball screw 38 reaches the second position, the second sensor 126 detects that the pole junction $P_D$ has reached a second signaling position with respect to the second sensor 126. Specifically, the second sensor 126 detects that the pole junction $P_D$ has reached the second signaling position because the detected North pole flux drops to 0, due to the South pole magnetic flux from the South pole face 114 canceling out the North pole magnetic flux from the North pole face 110. In some implementations, the second signaling position is defined by the position of the magnet 102 when the pole junction $P_D$ intersects a center 138 of the second sensor 126. In other implementations, the second signaling position is defined by the position of the magnet 102 when the pole junction $P_D$ is offset from the center 138 of the second sensor 126, taking into account the following factors: (1) timing of the signal sent from the second sensor 126 to the controller 134; (2) electronic logic delay of the controller 134 to interpret the signal received from the second sensor 126 to determine that the ball screw 38 has reached the second position; and (3) the speed of movement of the ball screw 38 as it travels toward the second position.

In response to the second sensor 126 outputting a signal to the controller 134 that indicates that the detected North pole flux has dropped to zero, the controller 134 stops rotation of the motor 12, thus stopping movement of the ball screw 38 in the second position. The broken mandrel is now free to slide through the spent-mandrel tube 74 for collection in the mandrel container 78. In contrast to including a magnet with a single-pole face (e.g., a North pole) in facing relationship with the PCB 120 and Hall-effect sensors 122, 126, because the magnet 102 has a North pole face 110 and South pole face 114 in facing relationship with the PCB 118, the second sensor 126 is able to more precisely detect when the ball screw 38 has reached the second position by detecting when the North pole flux has dropped to zero. Hall-effect sensors detecting a single-pole face of a magnet are more susceptible to variation of detected magnetic flux based on the distance separating the single-pole face magnet from the Hall-effect sensor. By more precisely determining when the ball screw 38 has reached the second position, potential damage to the pulling mechanism due to over-travel, i.e., traveling past the second position after the mandrel has been severed from the rivet, is reduced.

In other implementations, the second sensor 126 is a South pole detecting Hall-effect sensor and the controller 134 is able to determine that the ball screw 38 has reached the second position when the controller 134 receives a signal from the second sensor 126 indicating that detected South pole flux increases from zero to a non-zero value. Specifically, as the North pole face 110 approaches the South pole detecting Hall-effect second sensor 126, the second sensor 126 does not detect any South pole flux and thus, the detected value is zero. However, as the pole junction $P_D$ has reached the second signaling position, the second sensor 126 for the first time detects the South pole flux from the South pole face 114. Upon the controller 134 receiving a signal from the second sensor 126 indicating that detected South pole has increased from zero to a non-zero value, the controller 134 instructs the motor 18 to deactivate.

After stopping the motor 12, the controller 134 subsequently causes the motor 12 to rotate in a second rotational direction that is opposite the first rotational direction, causing the ball screw 38 to move from the second position back toward the first position. As noted above, when the ball screw 38 reaches the first position, the first sensor 122 detects that the magnet 102 is proximate the first sensor 122. The first sensor 126 detects when the ball screw 38 has reached the first position (indicating that the tool 10 is ready to set another rivet) because the magnet 102 includes adjacent North pole and South pole faces 110, 114. Specifically, in the illustrated implementation, the first sensor 122 is a South pole detecting Hall-effect sensor and is configured to output a signal indicative of detected South pole magnetic flux to the controller 134. As the magnet 102 translates along the magnet axis 118 toward the first sensor 122, the first sensor 122 first detects the South pole magnetic flux from the South pole face 114, prior to the ball screw 38 reaching the first position.

When the ball screw 38 reaches the first position, the first sensor 122 detects that the pole junction $P_D$ has reached a first signaling position with respect to the first sensor 122. Specifically, the first sensor 122 detects that the pole junction $P_D$ has reached the first signaling position because the detected South pole flux drops to zero, due to the North pole magnetic flux from the North pole face 110 canceling out the South pole magnetic flux from the South pole face 114. In some implementations, the first signaling position is defined by the position of the magnet 102 when the pole junction $P_D$ intersects a center 142 of the first sensor 122. In other implementations, the first signaling position is defined by the position of the magnet 102 when the pole junction $P_D$ is offset from the center 142 of the first sensor 122, taking into account the following factors: (1) timing of the signal sent from the first sensor 122 to the controller 134; (2) electronic logic delay of the controller 134 to interpret the signal received from the first sensor 122 to determine that the ball screw 38 has reached the first position; and (3) the speed of movement of the ball screw 38 as it travels toward the first position.

In response to the first sensor 122 outputting a signal to the controller 134 that indicates that the detected South pole flux has dropped to zero, the controller 134 stops rotation of the motor 12, thus stopping movement of the ball screw 38 in the first position. The operator is now able to start a new rivet setting operation. In contrast to using a magnet with a single-pole face (e.g. a North pole) as mentioned above, because the magnet 102 has a North pole face 110 and South pole face 114 in facing relationship with the PCB 118 with a pole junction $P_D$ therebetween that is detected by the first sensor 122, the first sensor 122 is able to more precisely detect when the ball screw 38 has reached the first position by detecting when the South pole flux has dropped to zero.

In other implementations, the first sensor 122 is a North pole detecting Hall-effect sensor and the controller 134 is able to determine that the ball screw 38 has reached the first position when the controller 134 receives a signal from the first sensor 122 indicating that North pole flux increases from zero to a non-zero value. Specifically, as the South pole face 114 approaches the North pole detecting Hall-effect first sensor 122, the first sensor 122 does not detect any North pole flux and thus, the detected value is zero. However, as the pole junction $P_D$ reaches the first signaling position, the first sensor 122 for the first time detects the North pole flux from the North pole face 110. Upon the controller 134 receiving a signal from the first sensor 122 indicating that detected North pole has increased from zero to a non-zero value, the controller 134 instructs the motor 18 to deactivate, stopping the ball screw 38 in the first position.

It should be understood that other configurations of North and South pole faces and North and South pole detecting Hall-effect sensors may be employed in other arrangements in order to detect the pole junction $P_D$ reaching a signaling position based on either increasing flux strength from zero or decreasing flux strength towards zero. In some implementations, the magnet may include two or more pole junctions. For example, the magnet 102 may include three, four, or any number of coplanar pole faces 110, 114 (e.g., alternating North and South in series along a length of the magnet 102) defining a pole junction $P_D$ between each adjacent pair of coplanar poles 110, 114. In such implementations with multiple pole junctions $P_D$, Hall effect sensors 122, 126 having the same pole-detection capabilities (e.g., both North pole detecting or both South pole detecting, rather than one North pole detecting and one South pole detecting) could be disposed at the first and second positions. In any implementation, the signal for deactivating the motor 18 may be generated based on the flux strength reaching (e.g., decreasing to or increasing to) a threshold value, which may be zero or a non-zero value, and may rely on whether the flux strength has reached zero and then subsequently risen.

As shown in FIG. 6, the magnet 102 includes a notch 146 to visually assist a manufacturer that is placing the magnet 102 on the carrier 86 during the assembly or manufacturing process, such that the North pole and South pole faces 110, 114 can be correctly oriented with respect to the first and second sensors 122, 126. By including a magnet 102 with North pole and South pole faces 110, 114 with a pole junction $P_D$ therebetween, the first and second sensors 122, 126 both have more precise sensing windows in determining when the ball screw 38 has reached the first and second positions, respectively. Thus, the controller 134 is able to more precisely stop the ball screw 38 in the first and second positions, achieving a benefit that is normally only available with traditional limit switches, while increasing the longevity of the pulling mechanism 18, as a magnet 102 in combination with Hall-effect sensors 122, 126 has greater longevity than traditional limit switches. In other implementations, the magnet 102 with North pole and South pole faces 110, 114 can be used in other applications and tools where precise sensing windows are necessary.

Although the disclosure has been described in detail with reference to certain preferred implementations, variations and modifications exist within the scope and spirit of one or more independent aspects of the disclosure as described. Various features of the invention are set forth in the following claims.

What is claimed is:

1. A rivet tool for setting a rivet, the rivet tool comprising:
- a motor;
- a pulling mechanism configured to receive torque from the motor, the pulling mechanism including
  - a carrier providing a support surface that is moveable between a first position and a second position in response to the pulling mechanism receiving torque from the motor,
  - a plurality of jaws configured to clamp onto a mandrel of the rivet and pull the mandrel in response to the carrier moving from the first position to the second position, and
  - a magnet mounted on the support surface and coupled for movement with the carrier, the magnet including a north pole face, an adjacent south pole face, and a pole junction therebetween, wherein the north and south pole faces face away from the carrier;
- a first sensor configured to detect the pole junction when the carrier is in the first position; and
- a second sensor configured to detect the pole junction when the carrier is in the second position;
- wherein one of the first sensor or the second sensor is a North pole-detecting Hall-effect sensor configured to filter for North pole flux, and wherein the other of the first sensor or the second sensor is a South pole-detecting Hall-effect sensor configured to filter for South pole flux; and
- wherein the magnet is formed as a single piece having the north pole face, the adjacent south pole face, and the pole junction.

2. The rivet tool of claim 1, wherein the north pole face and the south pole face are coplanar.

3. The rivet tool of claim 2, wherein the magnet is moveable along a face plane defined by the north pole face and the south pole face.

4. The rivet tool of claim 3, wherein the face plane is parallel to a pulling axis along which the carrier moves between the first and second positions.

5. The rivet tool of claim 1, wherein the magnet formed as a single piece further has at least two pairs of poles.

6. The rivet tool of claim 1, wherein the first sensor is the South pole-detecting Hall-effect sensor and is configured to detect the pole junction when the detected South pole flux drops from a non-zero absolute value to zero, and wherein the second sensor is the North pole-detecting Hall-effect sensor and is configured to detect the pole junction when the detected North pole flux drops from a non-zero absolute value to zero.

7. The rivet tool of claim 6, further comprising a controller, wherein in response to the controller receiving a signal from the first sensor indicating that South pole flux detected by the first sensor is zero, the controller is configured to deactivate the motor, and wherein in response to the controller receiving a signal from the second sensor indicating that north pole flux detected by the second sensor is zero, the controller is configured to deactivate the motor.

8. The rivet tool of claim 1, wherein the first sensor is the North pole-detecting Hall-effect sensor and is configured to detect the pole junction when the detected North pole flux has increased from zero to a non-zero absolute value, and wherein the second sensor is the South pole-detecting Hall-effect sensor and is configured to detect the pole junction when the detected South pole flux has increased from zero to a non-zero absolute value.

9. The rivet tool of claim 8, wherein in response to the controller further comprising a controller, wherein in response to the controller receiving a signal from the first sensor indicating that North pole flux detected by the first sensor has a non-zero absolute value, the controller is configured to deactivate the motor, and wherein in response to the controller receiving a signal from the second sensor indicating that South pole flux detected by the second sensor has a non-zero absolute value, the controller is configured to deactivate the motor.

10. A rivet tool for setting a rivet, the rivet tool comprising:
- a motor;
- a pulling mechanism configured to receive torque from the motor and pull the rivet, the pulling mechanism including
  - a carrier that is moveable between a first position and a second position in response to the pulling mechanism receiving torque from the motor, and
  - a magnet coupled for movement with the carrier, the magnet including a north pole face, an adjacent south pole face, and a pole junction therebetween; and
- a first sensor configured to detect the pole junction when the carrier is in the first position, wherein the north pole face and the south pole face each face the first sensor in the first position;
- a second sensor configured to detect the pole junction when the carrier is in the second position, wherein the north pole face and the south pole face each face the second sensor in the second position;
- wherein one of the first sensor or the second sensor is a North pole-detecting Hall-effect sensor configured to filter for North pole flux, and wherein the other of the first sensor or the second sensor is a South pole-detecting Hall-effect sensor configured to filter for South pole flux; and wherein the magnet is formed as a single piece having the north pole face, the adjacent south pole face, and the pole junction.

11. The rivet tool of claim 10, wherein the north and south pole faces face away from the carrier.

12. The rivet tool of claim 10, wherein the north pole face and the south pole face are coplanar.

13. The rivet tool of claim 10, wherein the magnet is moveable along a face plane coplanar with the north pole face and the south pole face, and wherein the face plane is parallel to a pulling axis along which the carrier moves between the first and second positions.

14. The rivet tool of claim 10, further comprising a controller configured to deactivate the motor based on a position of the pole junction detected by the first or second sensor.

15. The rivet tool of claim 10, further comprising a plurality of jaws configured to clamp onto a mandrel of the rivet and pull the mandrel in response to the carrier moving from the first position to the second position.

16. The rivet tool of claim 10, wherein the magnet formed as a single piece further has at least two pairs of poles.

17. The rivet tool of claim 10, wherein the first sensor is the South pole-detecting Hall-effect sensor and is configured to detect the pole junction when the detected South pole flux drops from a non-zero absolute value to zero, and wherein the second sensor is the North pole-detecting Hall-effect sensor and is configured to detect the pole junction when the detected North pole flux drops from a non-zero absolute value to zero.

18. The rivet tool of claim 17, further comprising a controller configured to deactivate the motor based on the flux dropping to zero.

19. The rivet tool of claim 10, wherein the first sensor is the North pole-detecting Hall-effect sensor and is configured to detect the pole junction when the detected North pole flux has increased from zero to a non-zero absolute value, and wherein the second sensor is the South pole-detecting Hall-effect sensor and is configured to detect the pole junction when the detected South pole flux has increased from zero to a non-zero absolute value.

20. The rivet tool of claim 19, further comprising a controller configured to deactivate the motor based on the flux reaching the non-zero absolute value.

21. A power tool, comprising:

a motor;

a magnet including a north pole face, an adjacent south pole face, and a pole junction therebetween;

a carrier configured to support the magnet, the carrier being moveable between a first position and a second position, wherein the magnet is coupled for movement with the carrier, wherein the north and south pole faces face away from the carrier;

a first sensor configured to detect the pole junction when the carrier is in the first position;

a second sensor configured to detect the pole junction when the carrier is in the second position; and a controller configured to control the motor based on a position of the pole junction detected by the first and second sensors;

wherein one of the first sensor or the second sensor is a North pole-detecting Hall-effect sensor configured to filter for North pole flux, and wherein the other of the first sensor or the second sensor is a South pole-detecting Hall-effect sensor configured to filter for South pole flux; and wherein the magnet is formed as a single piece having the north pole face, the adjacent south pole face, and the pole junction.

22. The power tool of claim 21, wherein the magnet formed as a single piece further has at least two pairs of poles.

23. The power tool of claim 22, wherein the at least two pairs of poles include a first pair of poles and a second pair of poles, the first pair of poles including the north pole face and a corresponding south pole face, and the second pair of poles including the south pole face and a corresponding north pole face.

24. The power tool of claim 21, wherein the magnet formed as a single piece further includes two or more pole junctions.

25. The power tool of claim 21, wherein the first sensor is the South pole-detecting Hall-effect sensor and is configured to detect the pole junction when the detected South pole flux drops from a non-zero absolute value to zero, and wherein the second sensor is the North pole-detecting Hall-effect sensor and is configured to detect the pole junction when the detected North pole flux drops from a non-zero absolute value to zero.

26. The power tool of claim 21, wherein the first sensor is the North pole-detecting Hall-effect sensor and is configured to detect the pole junction when the detected North pole flux has increased from zero to a non-zero absolute value, and wherein the second sensor is the South pole-detecting Hall-effect sensor and is configured to detect the pole junction when the detected South pole flux has increased from zero to a non-zero absolute value.

* * * * *